US005433077A

United States Patent [19]

Yoshino

[11] Patent Number: 5,433,077

[45] Date of Patent: Jul. 18, 1995

[54] ACTUATOR CONTROL DEVICE WITH METER-OUT VALVE

[75] Inventor: Kazunori Yoshino, Kobe, Japan

[73] Assignee: Shin Caterpillar Mitsubishi Ltd., Tokyo, Japan

[21] Appl. No.: 339,954

[22] Filed: Nov. 15, 1994

[30] Foreign Application Priority Data

Nov. 15, 1993 [JP] Japan ..... 5-285161

[51] Int. Cl.[6] ..... F16K 3/32; F16D 31/02

[52] U.S. Cl. ..... 60/461; 60/466

[58] Field of Search ..... 60/461, 462, 463, 466

[56] References Cited

U.S. PATENT DOCUMENTS

| | | | |
|---|---|---|---|
| 3,125,324 | 3/1964 | Vivier | 60/466 X |
| 3,175,354 | 3/1965 | Firth et al. | 60/466 X |
| 3,872,671 | 3/1975 | Verlinde | 60/466 X |
| 4,644,849 | 2/1987 | Tanaka | 60/466 X |

FOREIGN PATENT DOCUMENTS

| | | | |
|---|---|---|---|
| 193910 | 11/1983 | Japan | 60/466 |

*Primary Examiner*—John E. Ryznic

*Attorney, Agent, or Firm*—Peter Jon Gluck; Morrison Law Firm; Thomas R. Morrison

[57] ABSTRACT

A control valve feeds pressurized fluid for moving an actuator in first and second directions. A meter-out valve controls return flow of pressurized fluid from the actuator during actuation in the second direction. The meter-out valve is controlled by a pilot pressure controller independently of the actuator in response both to pilot pressures and to engine speed. The meter-out valve includes both a restricted channel and an unrestricted channel. The restricted channel, and the unrestricted channel are selectively connected dependent on the pilot pressures and the engine speed to supply sufficient fluid flow to permit stable operation of the actuator.

3 Claims, 5 Drawing Sheets

ACTUATOR CONTROL DEVICE WITH METER-OUT VALVE

BACKGROUND OF THE INVENTION

The present invention relates to control devices for actuators. More particularly, the present invention relates to a control device for an actuator of construction equipment.

In conventional circuits used to control, for example, hydraulic cylinders, providing for stable and continuous operation has proven highly problematic. This difficulty is heightened by the constraints involved in high-speed engine operation. Attempts have been made to solve these problems using known circuits.

Turning now to FIG. 5, an example of one of such conventional circuits is shown. A main pump 12 is driven by an engine 11 to feed pressurized fluid through a discharge port 12 and an oil feed channel 13 to inputs of a plurality (three in the illustrated embodiment) of control valves 14*a*, 14*b*, and 14*c*. Directional control valve 14*a* is shown in schematic detail. Directional control valves 14*b* and 14*c* are identical to control valve 14*a*, and internal details thereof are omitted.

Directional control valves 14*a*, 14*b*, and 14*c* feed working fluid to actuators 15*a*, 15*b*, and 15*c*. The direction and volume of flow of the fluid is controlled by respective spools of control valves 14*a*, 14*b*, and 14*c*. Working fluid discharged from actuators 15*b* and 15*c* returns to a tank line 16, through an oil return channel and control valves 14*a*, 14*b*, and 14*c*.

Control valve 14*a* controls the feeding of pressurized fluid on upper oil feed channel 22 and lower oil feed channel 23 to an actuator 15*a*, a hydraulic cylinder. Actuator 15*a* is the target cylinder (the object to be controlled).

A pilot pump 17 is driven by engine 11 to feed pressurized fluid on a pilot pressure line 18 to a plurality of pilot valves 19*a*, 19*b*, and 19*c*.

Each pilot valve 19*a*, 19*b*, and 19*c* is controlled by its respective operating lever 20*a*, 20*b*, and 20*c*. Operating levers 20*a*, 20*b*, and 20*c* are controlled by an operator of the construction equipment.

Pilot valves 19*a*, 19*b*, and 19*c* control the flow of pressurized fluid from pilot pressure line 18 to pilot pressure receiving sections of respective pilot lines a1/a2, b1/b2 and c1/c2.

In its quiescent condition shown in the figure, operating lever 20*a* is in its neutral (unactuated) position. In this position, the spool of control valve 14*a* blocks the flow of pressurized fluid to and from upper and lower oil feed channels 23 and 22. A return channel 26 in control valve 14*a* permits return flow of fluid from a common return line 27 carrying discharge fluid from control valves 14*b* and 14*c*.

In addition to its quiescent condition, control valve 14*a* may be displaced into one of two operating positions. When operating lever 20*a* of pilot valve 19*a* is biased in the direction a1, the spool of control valve 14*a* is displaced upward by pilot pressure from pilot line a1 from its neutral position shown to a direct feed position in which metering oil channel 21 connects discharged fluid from upper oil feed channel 23 to a tank line 16, and connects fluid from check valve 29 to lower oil feed channel 22. This condition urges the piston in actuator 15*a* in the upward direction of moving an element (not shown) of the equipment of which the present control system is a part. In this position, common return line 27 is blocked by a return channel 26, which is closed in this position. A return-side throttle 25 restricts the flow of fluid therethrough to control the rate at which the piston of actuator 15*a* is capable of moving.

The second position of the spool of control valve 14*a* is in the downward direction. In this direction, the feeding and return flows from upper and lower oil feed channels 23 and 22 are reversed, compared to the first direction, whereby the piston of actuator 15*a* is moved downward. As in the first position, return flow of fluid from common return line 27 is blocked.

In the prior-art device, return-side throttle 25 is a fixed-diameter aperture whose size, and therefore whose maximum fluid flow rate, is fixed during manufacture of control valve 14*a*. The maximum fluid flow rate through control valve 14*a* is therefore determined at manufacture, and no provision exists to vary the rate at which the piston of actuator 15*a* moves. Although meter-in oil channel 21 is unrestricted, the flow rate therethrough is controlled by return-side throttle 25.

The maximum flow of oil that can be supplied by main pump 12 is proportional to the speed of rotation of engine 11. Stroke control of control valve 14*a* remains constant in relation to the angular degrees of actuation of operating lever 20*a*, regardless of quantity of available from main pump 12.

When engine speed is reduced, or other actuator spool or spools 14*b*, 14*c* are operated, the effect is the same as when the aperture of return-side throttle 25 is reduced because, even with control valve 14*a* set at full stroke the aperture of return-side throttle 25 is constant.

Under some conditions of inertial or gravity load, the aperture-limited flow of oil to actuator 15*a* may be insufficient to produce the required motion, or resist input forces. This may cause actuator 15*a* to void thereby produce temporary stoppage and generally unstable operation.

Such problems with required cylinder speed exceeding the available oil supply flow, and concomitant loss of control result in high levels of dissatisfaction among users.

Attempts have been made to simply increase the aperture size of the return-side throttle in order to eliminate the above drawbacks. This is not and adequate solution although it may prevent temporary stoppage of the system during operation. Problems of insufficient oil flow still remain during low engine speed or during simultaneous operation with other actuators.

Similarly, during high engine speed operation when actuator 15*a* is operated alone, large quantities of oil are restricted by return-side throttle 25, resulting in excessive heat generation.

OBJECTS AND SUMMARY OF THE INVENTION

In order to solve the above problem, the present invention controls the aperture of the oil return channel of a target actuator. This controls inertial load and power load, and prevents voiding of the target actuator. Similarly it reduces the calorific value (or heat produced per unit mass due to complete combustion) of fluid within the oil feed channels.

Accordingly, it is an object of the present invention to provide a control device for an actuator for construction equipment to control the aperture of the oil return channel of a target actuator.

It is a further object of the present invention to provide a control device for an actuator for construction equipment which controls inertial load and power load.

It is a still further object of the present invention to provide a control device for an actuator for construction equipment which prevents voiding of a target actuator and reduces calorific value of pressurized fluid within oil channels.

To satisfy the above objects, the present invention controls the flow capacity of the oil return channel of an actuator. This controls inertial load and power load, and prevents voiding of the target actuator. Similarly it reduces the heating of fluid within the oil feed channels.

Briefly stated, there is provided a device for controlling an actuator of construction equipment in which inertial load and power load are to be controlled by means of directional control valves which are modulated by respective operating levers to prevent voiding of a target actuator, and reduce heat generated in its return oil channel by means of controlling the aperture of the return oil channel.

According to an embodiment of the invention, there is provided a device for controlling an actuator of construction equipment by means of directional control valves which are modulated by respective operating levers, wherein, a meter-out circuit is provided between an actuator to be controlled and a tank line, said meter-out circuit being separated from a meter-in circuit which is connected to said control valves; and said meter-out circuit includes a meter-out valve having a throttle position and a large aperture position, said throttle position being adjusted by external signals which correspond to the strokes of the respective operating levers.

The above, and other objects, features and advantages of the present invention will become apparent from the following detailed description of the present invention.

DETAILED DESCRIPTION OF THE PREFERRED EMBODIMENT

Figure 1:
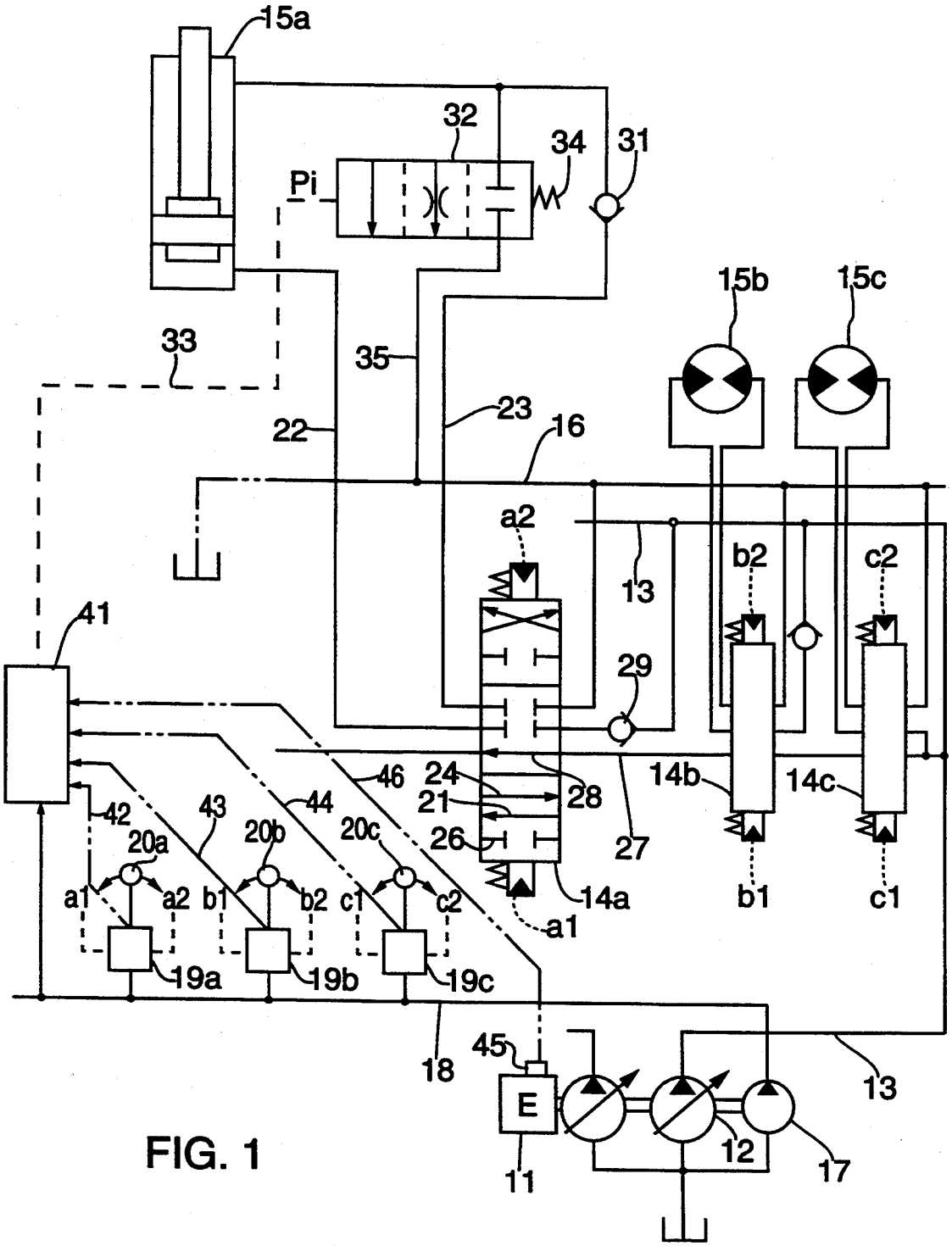
FIG. 1 is a hydraulic circuit diagram of an actuator control device of construction equipment according to an embodiment of the present invention.

Referring to FIG. 1, lower oil feed channel 23 of actuator 15*a*, which is the actuator to be controlled, includes a check valve 31. Lower oil feed channel 23 is connected to an input side of a meter-out valve 32. An output side of meter-out valve 32 is connected to tank line 16.

Directional control valve 14*a*, controls actuator 15*a*, whose piston is the element being controlled. Meter-out valve 32 is controlled by balancing the return force of a spring 34 and an external force Pi on an external signal line 33. The external force is produced in a pilot pressure controller 41 in response to pilot pressures applied thereto controlled by pilot valves 19*a*, 19*b* and 19*c*. Pilot pressure directly from pilot pump 17 is connected to an input of pilot pressure controller 41.

Figure 5:
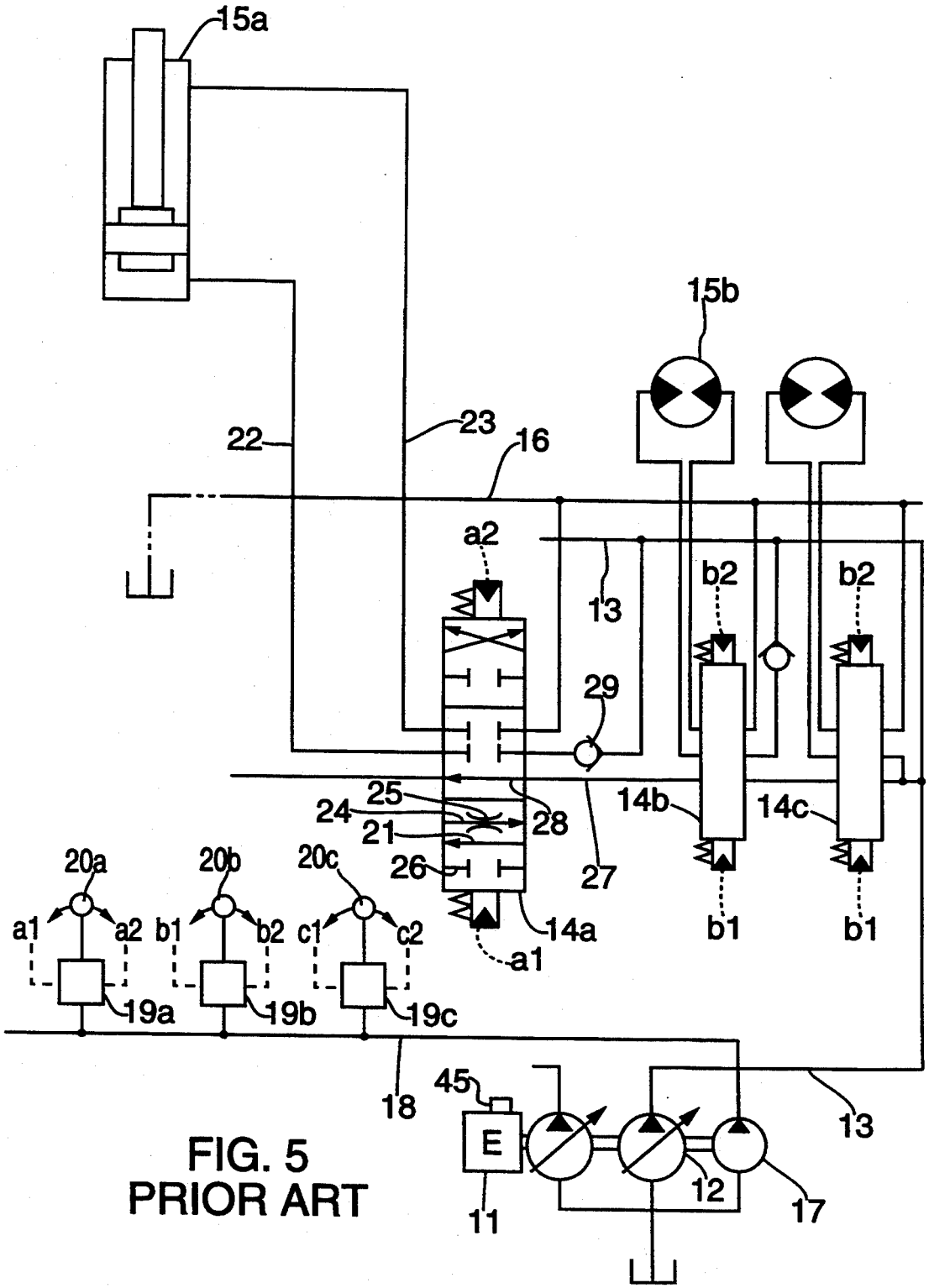
FIG. 5 PRIOR ART
FIG. 5 is a prior art hydraulic circuit diagram of an actuator control device of construction equipment.

Unlike a conventional fixed throttle meter-out valve 32 of the present invention is controlled independently of the position of control valve 14*a* between a closed position, corresponding to the quiescent position of the prior-art embodiment of FIG. 5, a throttled position, corresponding to the first position of FIG. 5, and a non-throttled position, corresponding to the second position of FIG. 5. Independent control of meter-out valve 32 permits control of return flow that responds proportionately to engine speed and load requirements in a flexible manner not possible with the fixed aperture of return-side throttle 25. A check valve 31 in upper oil feed channel 23 prevents oil return to control valve 14*a*.

With the conventional circuits of FIG. 5, return-side throttle 25 in meter-out oil channel 24, of control valve 14*a*, is required because an independently controlled meter-out valve 32 having an adjustable throttle position is absent.

Since return line 35 from meter-out valve 32 is directly connected to tank line 16, permitting oil to return there through to the tank, it is unnecessary to return the oil to control valve 14*a*.

Pilot pressure controller 41, is included between a pilot pressure line 18 and pilot pump 17. External signal line 33 applies control forces Pi to meter-out valve 32 from pilot pressure controller 41 for controlling meter-out valve 32 according to the strokes of operating levers 20*a*, 20*b*, and 20*c*.

Pilot pressure controller 41 receives pilot pressures on pilot lines 42, 43, and 44 produced by actuation of operating levers 20*a*, 20*b*, and 20*c*, respectively of pilot valves 19*a*, 19*b*, and 19*c*. An engine speed detector 45, connected to engine 11, produces a signal proportional to engine speed which is connected on a signal line 46 to pilot pressure controller 41.

Control valve 14*a* is urged from the neutral position shown in the drawing to its upper position by pressure from pilot line a1 produced by manually moving the operating lever of pilot valve 19*a* in the direction a1. Working fluid is fed from meter-in oil channel 21 through oil feed channel 22 to the lower end of actuator 15*a*. This urges the piston of actuator 15*a* in the upward direction.

At that time, return oil displaced from the upper side of the piston of actuator 15*a* by the upward displacement of actuator 15*a* flows through either the throttled channel or the fully open channel, as selected by the position assumed by meter-out valve 32, under control of pilot pressure signals Pi from pilot pressure controller 41. The fluid from meter-out valve 32 is discharged through return line 35 to tank line 16.

When control valve 14*a* is shifted by pilot pressure from pilot line a2 the lower position working fluid is fed through control valve 14*a* upper oil feed channel 23 and check valve 31 directly fed into the upper side of. This urges the spool of actuator 15a into its retracted position.

During retraction, oil displaced from the lower side of actuator 15a is discharged through oil channel 22 and control valve 14a to tank line 16.

Figure 2:
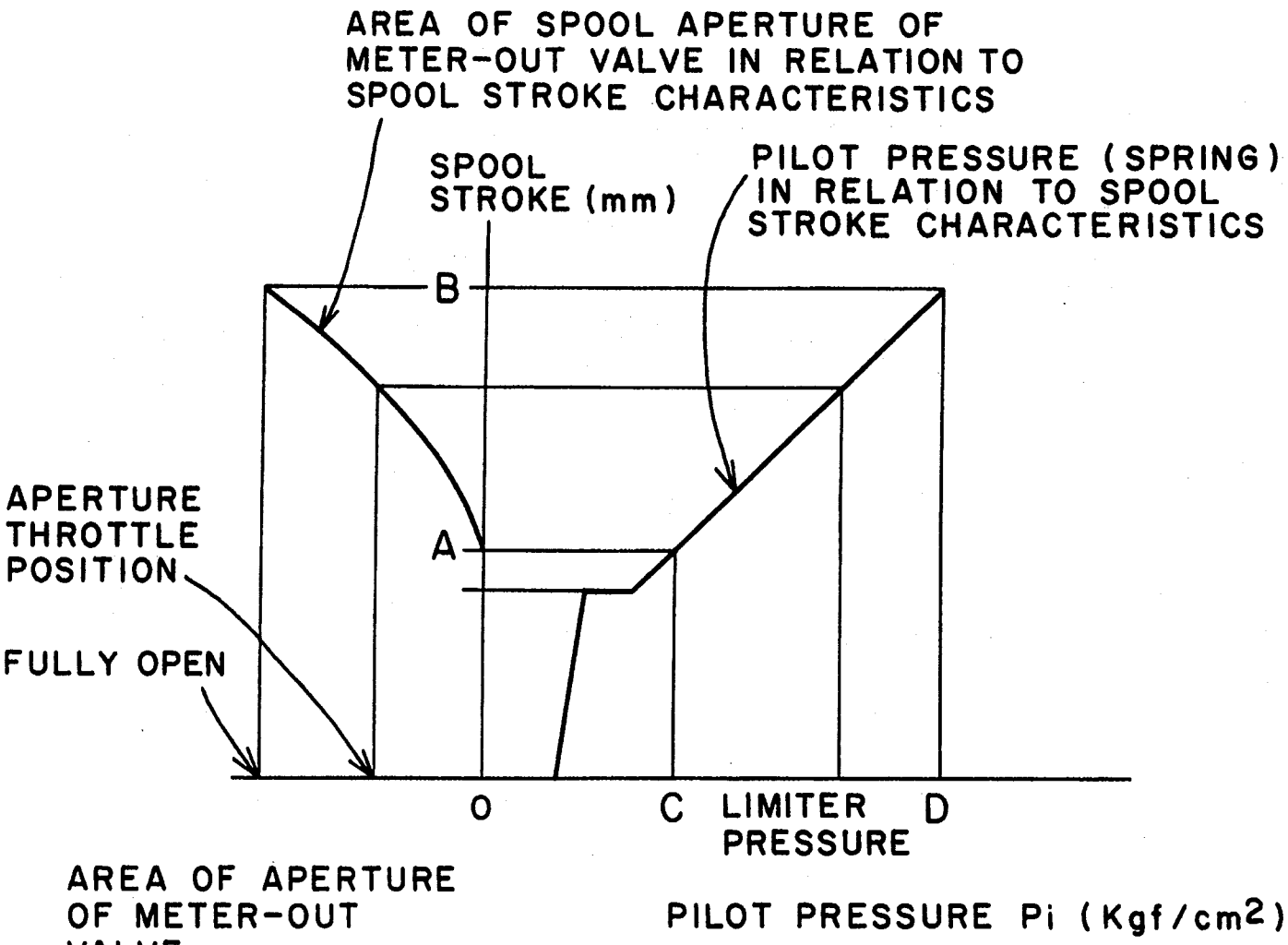
FIG. 2 is a characteristic diagram showing correlation between the area of the aperture of a meter-out valve used in the control device and its spool stroke and also showing correlation between the spool stroke and pilot pressure according to an embodiment of the present invention.

Referring now to FIG. 2, a correlation is shown between the area of the spool aperture of meter-out valve 32 of the present invention and its spool stroke as well as correlation between spool stroke of meter-out valve 32 and pilot pressure.

Figure 3:
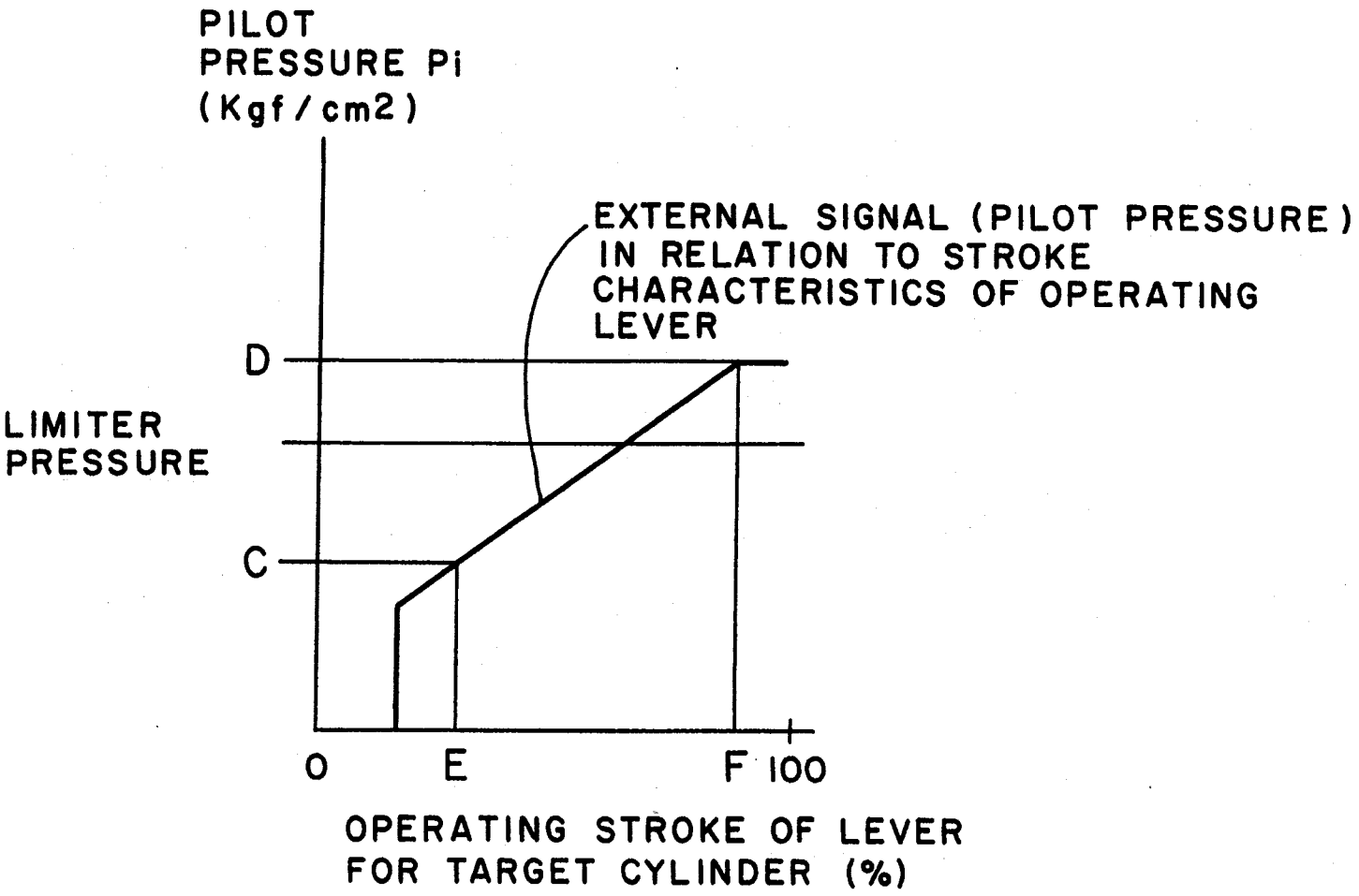
FIG. 3 is a diagram illustrating correlation between external signals representing pilot pressure to the meter-out valve and operating stroke of a lever for operating an actuator according to an embodiment of the present invention.

Referring now to FIG. 3, a correlation is shown between external signals representing pilot pressure Pi, which corresponds to the pilot pressure mentioned above, and the operating stroke of the operating lever of pilot valve 19a for actuator 15a.

Figure 4:
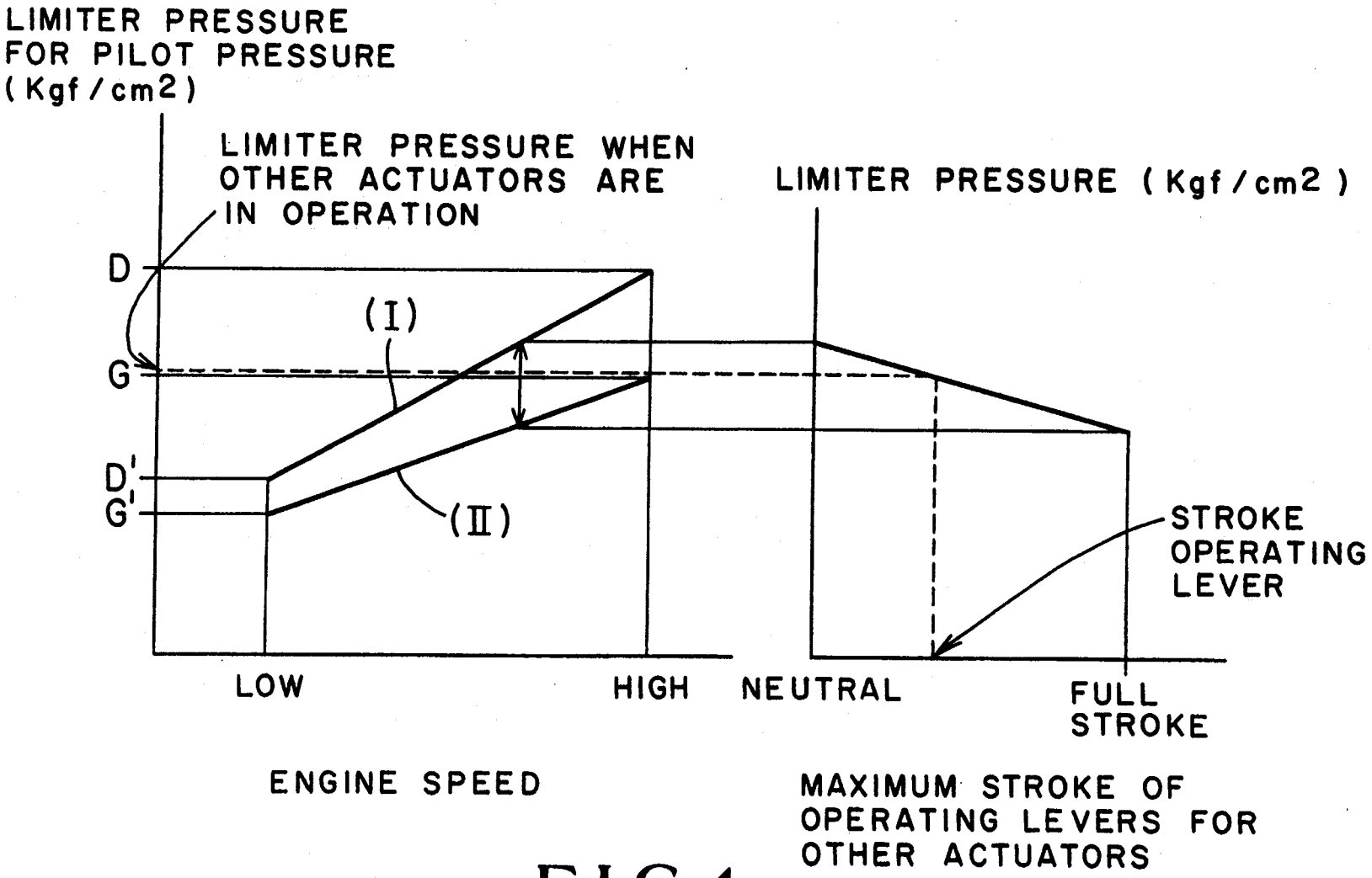
FIG. 4 is a diagram illustrating correlation between limiter pressure of the pilot pressure and engine speed which also illustrates correlation between limiter pressure and the maximum strokes of the operating levers for operating the other actuators according to an embodiment of the present invention.

Referring now to FIG. 4, a correlation is shown between limiter pressure which exists in relation to pilot pressure Pi and engine speed detected by sensor 45 as well as correlation between the maximum degree of the strokes of the operating levers of pilot valves 19b/19c for the other actuators and limiter pressure.

Referring again to FIGS. 2 to 4, when actuator 15a that includes meter-out valve 32 is operated alone, the lever-operating strokes for the other actuators are zero. Therefore, the maximum value on the solid line representing characteristic values of limiter pressure shown in the right graph of FIG. 4 is the limiter pressure actually applied, and a value which is on the upper line (line I) representing limiter pressures corresponding to an arbitrary engine speed is adopted as a limiter value in FIG. 3.

When actuators 15b/15c are operated simultaneously, the pressure of the limiter changes according to the degree of the operation stroke of their operating levers in such a manner as to smoothly deviate from the line I towards line II in FIG. 4.

Respective terminal points D' and G' on the upper limit line (line I) and the lower limit line (line II) of limiter pressures are slightly greater in this case than the lower limit (pressure C) for lever modulation shown in FIG. 3.

Referring now specifically to FIG. 3, the operating lever of pilot valve 19a for actuator 15a is operated within the modulation range between lever stroke points E and F in order to control pilot pressure Pi between pressure point C, which is identical to the valve opening pressure of meter-out valve 32, and pressure point D, which is identical to the full aperture pressure.

Referring now also to FIG. 4, when the engine speed is low at the same time that the operating lever for actuator 15a is operated to its full stroke, i. e. point F, the maximum value of pilot pressure Pi shown in FIG. 3 is limited by limiter pressure defined by line I in FIG. 4. In cases where the engine speed is low and another actuator or other actuators are operated by means of their respective operating levers, the maximum value of pilot pressure Pi shown is also limited by limiter pressure which is determined by either line II in FIG. 4 or intermediate characteristics between lines I and II. Therefore, instead of being fully opened, meter-out valve 32 is maintained at the throttle position corresponding to the limiter pressure as shown in FIG. 2 and consequently prevents voiding of actuator 15a which may otherwise be caused by insufficient working fluid.

When the engine speed is sufficiently high and the other actuators 15b/15c remain unoperated, the limiter value is at point D and identical to the full aperture pressure, wherein meter-out valve 32 is fully open. Since a large quantity of oil is available to flow without being throttled, there is no danger of generation of excessive heat.

Having described preferred embodiments of the invention with reference to the accompanying figures, it is to be understood that the invention is not limited to those precise embodiments, and that various changes and modifications may be effected therein by one skilled in the art without departing from the scope or spirit of the invention as defined in the appended claims.

What is claimed is:

1. A device for controlling an actuator using pressurized fluid from a pump driven by an engine comprising:

a control valve:

said control valve having a quiescent position and first and second actuated positions;

means in said control valve, effective in said first actuated position for feeding actuating fluid to said actuator in a direction effective for moving said actuator in a first direction;

means in said control valve, effective in said second actuated position for feeding actuating fluid to said actuator in a direction effective for moving said actuator in a second direction;

at least one pilot valve;

means, responsive to said at least one pilot valve for controlling displacement of said control valve between said quiescent position, said first position and said second position;

a meter-out valve;

said meter-out valve having a quiescent position and third and fourth actuated positions;

said meter-out valve receiving all return fluid from an upper side of said actuator;

said quiescent position of said meter-out valve being a blocking position;

said third position including a throttle;

said fourth position including an unrestricted flow channel;

means for controlling said meter-out valve independently of control of said control valve; and said means for controlling said meter-out valve being further responsive to a speed of said engine to selectively use said third position and said fourth position as required to maintain sufficient flow of said pressurized fluid to maintain stable operation of said actuator.

2. A device according to claim 1, further comprising a check valve bypassing said meter-out valve while said control valve is in said second position, whereby direct flow of pressurized fluid to said actuator is enabled.

3. A device for controlling an actuator of construction equipment as claimed in claim 2, said means for controlling said meter-out valve includes means for adjustably controlling a flow in said fourth position to maintain stable operation of said actuator.

* * * * *